340-552 SR
8/12/86 XR 4,605,914

United States Patent [19]
Harman

[11] Patent Number: 4,605,914
[45] Date of Patent: Aug. 12, 1986

[54] SHUNT TRANSMISSION LINE FOR USE IN LEAKY COAXIAL CABLE SYSTEM

[75] Inventor: R. Keith Harman, Kanata, Canada

[73] Assignee: Senstar Security Systems Corp., Ontario, Canada

[21] Appl. No.: 584,445

[22] Filed: Feb. 28, 1984

[30] Foreign Application Priority Data

Jun. 16, 1983 [CA] Canada ..... 430532

[51] Int. Cl.[4] ..... H01P 3/06; H01Q 1/04
[52] U.S. Cl. ..... 333/237; 340/552; 343/719
[58] Field of Search ..... 333/237; 343/770, 771, 343/719; 340/552, 553, 554, 567

[56] References Cited

U.S. PATENT DOCUMENTS 4,115,781 9/1978 Gershberg et al. ..... 333/237 X
4,129,841 12/1978 Hildebrand et al. ..... 333/237

FOREIGN PATENT DOCUMENTS 66746 5/1979 Japan ..... 333/237

*Primary Examiner*—Paul Gensler
*Attorney, Agent, or Firm*—Antonelli, Terry & Wands

[57] ABSTRACT

A leaky coaxial cable for use as a sensor in a buried or other medium, which has a conductor located parallel to, and in proximity with the shield along the cable, but insulated therefrom. Preferably the two wire transmission line formed by the external conductor and the shield is terminated with an impedance matching the characteristic impedance of the transmission line (for minimum reflections). The external conductor can be oriented to cause the field in a given direction (e.g. above the surface of the burial medium) to be compensated for field variations caused by variations in the burial medium.

21 Claims, 6 Drawing Figures

SHUNT TRANSMISSION LINE FOR USE IN LEAKY COAXIAL CABLE SYSTEM

This invention relates to a leaky coaxial cable, and in particularly to one which compensates for variations in external field intensity caused by variations in the surrounding medium.

Leaky (ported) coaxial cables have been utilized over the past decade for a number of applications including distributed communication lines and guided radar type sensors. In those applications, the cables have been installed with a very wide variety of conditions, ranging from free standing in air to being buried in heavy clay soil. In all such applications, significant variations in field strength along the cable length has been a very significant problem. The present invention is a leaky coaxial cable which utilizes a shunt transmission line, which provides a practical means of overcoming this problem.

While the shunt line technique can be applied to all applications of leaky coaxial cables, it represents a major technical advance in the use of leaky cables as sensor transducers. As sensor transducers, leaky coaxial cables are used to produce and to monitor an electromagnetic field in their vicinity. A number of different sensor processing techniques have been utilized including both pulsed and cw radio frequency transmissions. One particular application of this sensor technology is in the area of physical security as a means of detecting and locating human intruders at the perimeter of secure areas such as prisons, nuclear power plants and military bases. In such applications, the variations in electromagnetic fields produced by the cables and the reciprocal variations in susceptibility to electromagnetic field in proximity to the cables creates a number of problems. Security systems which use the leaky coaxial technique are described in Canadian Patent No. 1,014,245 issued July 19, 1977, and Canadian patent application Ser. No. 403,015, filed May 14, 1982 both invented by Keith Harman.

One problem to which such systems are subjected relates to the wide dynamic range of sensitivity to human intruders for cables buried in media with different or varying electrical properties. For example, systems with sensor cables buried in very dry sand have been found to be much more sensitive to intruders than the same systems with cables buried in heavy wet clay. In practical terms, this means that the system or sensor must be designed in such a way that a separate detection threshold can be set for cables buried in different media. While this approach partially overcomes the variation in sensitivity due to different media, it usually increases the sensor complexity and hence its cost.

The second and very serious problem relates to the significant variations in sensitivity along a buried cable sensor in what otherwise appears to be a homogeneous medium. In fact, the natural variations in the electrical properties of soils can create very significant sensitivity variations. By setting thresholds to detect a human intruder at the least sensitive location along a cable length, the sensor may detect a very small animal at the most sensitive location. This unwanted or nuisance alarm can severely limit the application of this sensor technology for perimeter security.

A third and even more serious problem relates to the variations in sensitivity caused by the effects of varying climatic conditions on the electrical properties of the burial medium. For example, changes in soil moisture content can significantly alter both the conductivity and the permittivity of most soils. The dramatic change due to frost is also a great concern. The resulting variations in sensitivity may force one to alter threshold settings to maintain adequate sensor performance during changing environmental conditions, thus increasing the cost of operation.

A fourth problem is the creation of unwanted effects of radiated fields. All discontinuities in the installation can create a radiated electromagnetic field. This radiated field can cause detection outside of the desired security detection zone or can create null spots in the usual detection zone. These problems are very bothersome and currently require a lot of fine tuning and adjustment during installation to overcome the effects, which is a very frustrating and costly process.

The leaky cable with shunt transmission line described in this patent application can be used as a general remedy for all of the above problems, compensating for variations in the field caused by the described effects. The line can be produced with the coaxial cable and installed in all applications, or it can be added during installation to modify particular areas of the detection zone.

In general, the invention utilizes a conductor, preferaby a wire, located parallel to and in proximity with the shield of the coaxial cable, along the cable, but insulated therefrom. A transmission line consisting of the conductor and the shield of the coaxial cable results. Preferably the transmission line is terminated by a termination circuit which is connected between the external conductor and the shield. If it is not terminated, the conductor can be angled away from the cable at its end.

The termination circuit can be matched to the impedance of the transmission line, or, if reflections along the coaxial cable are desired to compensate for null regions, the termination can be some other impedance. Indeed, the termination can be formed of a series resonant circuit comprised of a capacitor, resistor and inductor connected between the coaxial cable shield and the external conductor. The connection to the coaxial cable shield can be by means of the capacitor, i.e. a foil cylinder should surround the shield, insulated therefrom by the insulated jacket of the coaxial cable, the foil and the shield forming plates of the capacitor with the coaxial cable insulator forming the dielectric. Either the resistor or inductor is connected to the foil, and the remaining terminal is connected preferably to the end of the external conductor.

In general, therefore, the invention is, in a leaky cable system comprising a leaky coaxial cable transmission line which includes a center conductor and a leaky coaxial shield, a conductor located parallel to, and in proximity with a shield along the cable, but insulated therefrom.

A better understanding of the invention will be obtained by reference to the detailed description below in conjunction with the following drawings, in which.

Most leaky coaxial cable sensors utilize two or more cables buried in parallel. One or more cables are used to set up an electromagnetic field, by means of a radio frequency signal transmitted along one or more cables. The operation in the outer conductor (shield) of this cable (or cables) causes an electromagnetic field to propagate along the outside of the cable (or cables). In practice, the cables are buried relatively near the surface of the burial medium causing the electromagnetic field to extend into the air. This field appears to set up a surface wave which propagates along the interface between the air and the burial medium. This surface wave causes the radio frequency field which illuminates the intruder.

The reciprocal of this process results in movement of an intruder in an electromagnetic field setting up a signal inside a secure leaky cable (or cables). In this process, the intruder may be viewed as a radiating source which sets up a surface wave which in turn excites an external coaxial mode and hence an internal coaxial mode.

Figure 1A:
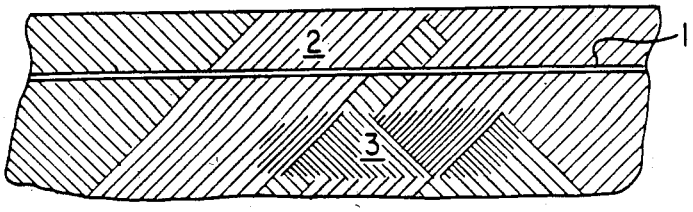
FIG. 1A is a section of the earth showing a buried leaky coaxial cable.

FIG. 1A is a section of the earth showing a leaky coaxial cable 1 in such a system buried in an earth medium 2. As an example, let us assume that the medium 2 is relatively homogeneous sand. However buried under the cable is a mass of heavy clay 3.

Figure 1B:
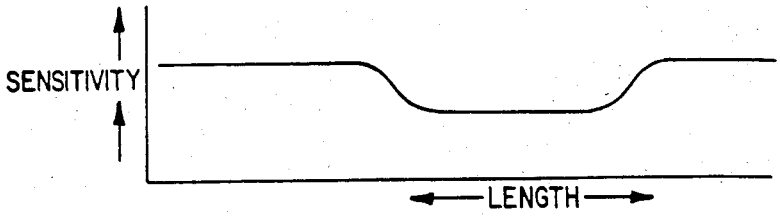
FIG. 1B is a graph showing the sensitivity of the cable along a length.

FIG. 1B shows a typical sensitivity curve of this cable along its length. The sensitivity for homogeneous sand is relatively constant, but in the vicinity of the heavy clay, the sensitivy decreases substantially since the permittivity and conductivity of the medium substantially increases. In the regions on either side of the heavy clay region, the sensitivities are shown to be approximately the same.

The sensitivity characteristic is similar whether the cable is a transmitter or receiver, the paragraph depicting either the emanated electric field of the transmitter, or the sensitivity of the sensor for the receiving leaky coaxial cable. Clearly there is a null or reduced sensitivity region above the heavy clay region. Further, effective discontinuities can be experienced at the edges of the heavy clay region, which can cause radiation, which radiated fields can cancel the closed electromagnetic fields of the leaky coaxial cable system at a distance from the discontinuities, causing null regions or regions having less sensitivity than others.

It is therefore highly desirable to compensate for both low sensitivity and undesirable higher sensitivity regions of the field.

According to the present invention, a conductor is added to the coaxial cable which runs parallel to and external to the outer conductor of the leaky coaxial cable. It is believed that the energy coupled through the apertures in the shield of the leaky coaxial cable travels along the cable length on both the two conductor line formed by the external conductor and the shield, and the inner conductor and shield of the coaxial cable. The distribution of energy appears to be inversely proportional to the characteristic impedance of the two transmission lines. Therefore as the burial medium becomes more lossy and the impedance of the outer coaxial cable mode decreases, it is believed that the energy travelling in the outer coaxial mode increases and energy in the two conductor lines decreases. This has the desirable effect of compensating for the normal loss of sensitivity which would occur with increase in losses in the burial medium, i.e., in the region of the heavy clay. Thus locating the external conductor adjacent the coaxial cable in the region of the heavy clay can maintain a more uniform sensor field.

The outer conductor (shield) of the leaky coaxial cable forms a two wire line with a parallel shunt wire. It is important to consider the impedances of this two wire line and that of the outer coaxial line.

(a) Impedance of the Two Wire Line

In the text ELECTROMAGNETICS, by J. D. Kraus and K. R. Carver, McGraw Hill 1973, the impedance of the two wire line is shown to be able to be calculated using the following equations.

$$Z_2 = \frac{60}{\sqrt{\epsilon r}} \cosh^{-1} N \tag{1}$$

$$N = \tfrac{1}{2}\left[\frac{4D^2}{d_1 d_2} - \frac{d_1}{d_2} - \frac{d_2}{d_1}\right] \tag{2}$$

where D is the distance between centers of the coaxial line and the shunt wire, $d_1$ is the diameter of the outer conductor of the coaxial line and $d_2$ is the diameter of the shunt wire.

(b) Impedance of the Outer Coaxial Line

An approximation for the impedance of an insulated conductor buried in a homogeneous medium as presented in the text COUPLING TO SHIELDED CABLE, by E. F. Vance, John Wiley & Sons 1979:

$$Z_c = \frac{Z_g}{\gamma} \tag{3}$$

$$Z_g = \frac{w\mu_o}{8} + \frac{jw\mu_o}{2\pi} \ln\left(\frac{1.588\delta}{d_1}\right) \tag{4}$$

$$\gamma = \sqrt{jw\mu_o(T + jw\epsilon_o\epsilon_r)} \tag{5}$$

$$\delta = \sqrt{\frac{2}{w\mu_o T}} \tag{6}$$

where w is the radian frequency, $\mu_o$ is the permeability of free space, $\epsilon_o$ is the permittivity of free space, $\epsilon_r$ is the relative permittivity of the burial medium and is the skin depth in the burial medium.

Typical values for $Z_c$ and $Z_2$ range from 150–50 ohms and 100 to 25 ohms. For example, if $Z_2$ is 50 hms, the combined impedance formed by $Z_c$ in parallel with $Z_2$ ranges from 37.5–25 ohms for the 150–50 range of $Z_c$.

The attenuation of the leaky coaxial line is thus increased by the addition of the shunt wire. More importantly, however, the changes in this attenuation due to changes in the electrical properties of the burial medium are substantially reduced.

The termination of the shunt transmission line has a very significant effect on the electromagnetic field produced by the leaky coaxial cable. By definition, a terminatin of $Z_c$ ohms, the characteristic impedance, will eliminate all reflections of signals propagating in the two wire line. While this is the normal practice for general application of shunt lines, there may be occasions when a mismatched load is desired to create a particular field pattern.

In practice, it is also important to consider the orientation of the shunt line relative to the desired detection zone. It has been observed that the orientation of the shunt line can produce fields which are additive or subtractive. It has been found that for a coaxial line buried close to the surface of the earth, in order to increase the field above the earth, the external conductor should be below the coaxial cable. Where there is extraordinarily high sensitivity, the external conductor can be located above the coaxial cable in order to decrease the field above the earth.

Figure 2A:
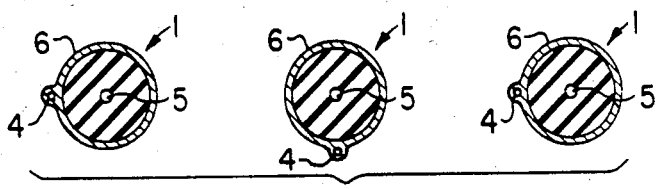
FIG. 2A are axial views of the invention when buried so as to compensate for variations in sensitivity.

FIG. 2A shows three cross sections of a leaky cable according to the invention. The cable is, for example, located in place of cable 1, with its orientation such as to cancel the effects of the heavy clay region 3. On the left side cross sectional view, the coaxial cable 1 has an outer parallel conductor 4 running along its length, located along a plane which is horizontal (or parallel to the surface of the earth) through the center conductor 5 of the coaxial cable. A predetermined field can then be measured above the surface of the earth.

However, in the region adjacent the edge of the heavy clay area 3, the cable should be twisted (or the external conductor oriented) so that the external conductor 4 is below the center conductor 5 as shown in the centre cross sectional view. The result will be increased field intensity from the leaky coaxial cable above the earth.

Once the other edge of the heavy clay region is encountered, the cable can be twisted back to its original orientation (or the external conductor oriented) with the external conductor to the side of the cable, as shown in the right-hand cross-section view in FIG. 2A.

In this way, the cable can be turned in order to orient the external conductor to compensate for variations in conductivity and permittivity of the burial medium.

Figure 2C:
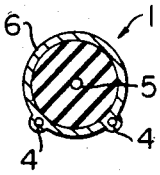
FIG. 2C is an axial view of the invention having two external conductors.
Figure 2B:
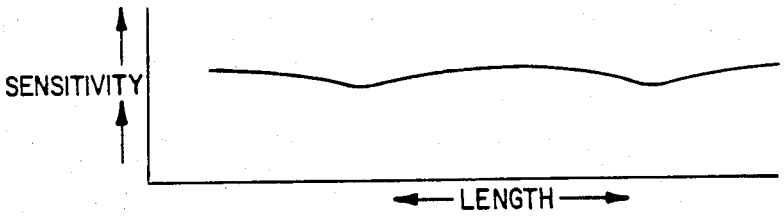
FIG. 2B is a qraph showing sensitivity along the cable after compensation by the use of this invention.

FIG. 2B shows a representative sensitivity curve of a coaxial cable according to this invention located in place of cable 1 in FIG. 1A, after orientation of its external conductor so as to compensate for variations in conductivity and permittivity of the burial medium. It may be seen that the sensitivity is relatively constant. Clearly a substantial advance in the art has been realized.

While the external conductor can be merely laid along the coaxial cable (insulated therefrom, of course, by the insulated jacket of the coaxial cable), it is preferred that it should be molded into place with the jacket. This form of the invention can be seen in FIG. 2A, the jacket 6 extending outwardly to enclose external conductor 4, which, preferably, is in the form of a wire.

In order to have the field as reflection free as possible, the external conductor 4 should be terminated to the shield of the coaxial cable by an impedance which matches the characteristic impedance of the two wire line formed by the external conductor 4 and the shield of the coaxial cable. While this would be the normal practice, there may be occasions when a mismatched load would be desirable, to create a particular predetermined field pattern.

Figure 3:
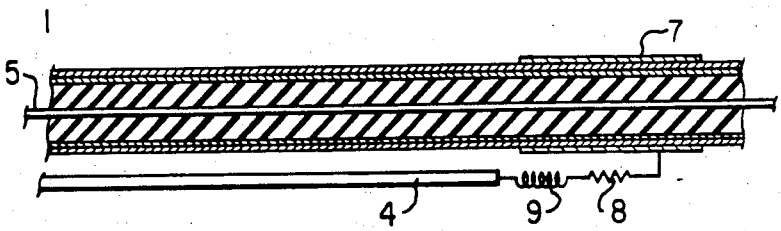
FIG. 3 is a length of leaky coaxial cable according to this invention showing one form of termination.

In some cases, it would be desirable to terminate the two wire line by means of a resonant circuit. The invention in elongated cross section is shown in FIG. 3 with this type of termination. The resonant circuit would be formed of the series circuit of a capacitor, inductor and resistor, connected between the end of the external conductor and the shield. While such a connection is feasible, it is preferred not to puncture the insulative jacket of the coaxial cable which could allow water to enter. Consequently the capacitor of the resonant circuit is preferred to be formed by a cylinder of conductor foil 7 which surrounds the insulative jacket of the coaxial cable, the insulative jacket forming a capacitor dielectric between the conductive foil (which is one plate of the capacitor) and the shield of the coaxial cable (which forms the other plate of the capacitor). A resistor 8 and inductor 9 are connected between the foil 7 and the external conductor 4. The resonant circuit, of course, forms the termination to the two wire line as described above.

The external conductor can thus be used along the entire leaky coaxial cable sensor from end to end, with the external conductor oriented as described above in order to even out the changes in sensitivity of the system. Alternatively, segments of external conductors can be placed in the earth adjacent the coaxial cable and terminated thereto, as is needed.

It has been found that the combined effect of the leaky coaxial cable and external conductor is a directive line in which the field is less susceptible to the changes in electrical properties of the burial medium.

While wires can be laid along the coaxial cable only where needed, it is preferred that the external conductor should be molded in the outer jacket of the coaxial cable along the entire length of the cable. After being placed in the burial medium and the cable tested, regions of increased or decreased sensitivity are noted. The installer then digs to the cable and turns it to reorient the location of the external conductor (i.e. within 90° of a plane passing through the center axis of the coaxial cable), in order to adjust its sensitivity.

There is a further advantage to the use of an external conductor along the entire length of the cable rather than using pieces only where needed. DC current or data signals can be passed along the external wire for powering auxiliary devices located in the field along the cable or which can be connected thereto for transmission of signals (i.e. fence vibration detectors, fire alarm signals, etc.).

It should also be noted that multiple external conductors can be used. For example, two or more external conductors can be located in adjacency with the coaxial cable, at a predetermined angle about the center conductor of the coaxial cable as shown in FIG. 2C. The multiple lines can be used to increase the data or power transmission capability of the combination. Of course filters may be required to separate the radio frequency path from low frequency data and power frequencies. Thus, the addition of the external conductor 4 provides additional benefits, that of carrying power and data along the cable (in addition to that of the radio frequency signals carried by the coaxial cable itself), and forms a shunt line which facilitates compensation for variation in the conductivity and permittivity of the burial medium.

In addition, the external conductor aids in physically strengthening the coaxial cable and provides additional protection against rodents chewing into the leaky cable dielectric.

This invention clearly facilitates an increase reliability of leaky cable systems for which variations in sensitivity has caused substantial problems. Thus with the use of this invention a leaky coaxial cable system can be utilized with confidence in burial media which vary from concrete or asphalt overlay, variable soil conditions, sand, heavy clay, top soil, etc., with relatively constant sensitivity.

A person understanding this invention may now conceive of alternative embodiments and variations in this invention while using the principles described herein. All are considered to be within the sphere and scope of this invention as defined in the claims appended hereto.

I claim:

1. In a leaky cable system comprising a buried leaky coaxial cable transmission line which includes a center conductor and a coaxial shield, an external elongated conductor having width much smaller than the diameter of the shield and having length greater than one-half wavelength of signal carried by the cable, being fixed parallel to, and in proximity with the shield along the cable, but insulated therefrom.

2. In a leaky cable system as defined in claim 1, a termination circuit connected between the external conductor and the shield.

3. In a leaky cable system as defined in claim 1, whereby field strength enhancement is desired in a particular radial direction from the coaxial cable, the external conductor being located along the cable opposite said radial direction.

4. In a leaky cable system as defined in claim 1, the external conductor being formed of a wire.

5. In a leaky cable system as defined in claim 4, a termination circuit connected between the external conductor and the shield.

6. In a leaky cable system as defined in claim 4, a termination circuit substantially matching the characteristic impedance of a transmission line formed by the external conductor and the coaxial cable shield, connected between the external conductor and the shield.

7. In a leaky cable system as defined in claim 6 in which the termination circuit is connected between the external conductor and the shield at a remote end of the external conductor.

8. In a leaky coaxial cable system as defined in claim 4, a resonant circuit formed of an inductor in series with a capacitor and a resistor, the capacitor providing one terminal of the resonant circuit and being formed of a conductive foil covering a portion of the coaxial cable shield but insulated therefrom by an insulative jacket of the cable, the other terminal being connected to the external conductor.

9. In a leaky cable system as defined in claim 4, a termination circuit connected between the external conductor and the shield in which the impedance of the termination circuit is predetermined and different from the characteristic impedance of a transmission line formed by the external conductor and the coaxial cable shield, whereby reflections of an electromagnetic field emanating from the leaky coaxial cable are produced at desired locations along the coaxial cable.

10. In a leaky cable system as defined in claim 4, the wire being the length of the transmission line.

11. In a leaky cable system as defined in claim 10, whereby field strength enhancement is desired in a particular radial direction from the coaxial cable, the external conductor being located along the cable opposite said radial direction.

12. In a leaky coaxial cable system as defined in claim 1, at least one additional external wire spaced a predetermined angle about the axis of the coaxial cable from the first defined external wire, located parallel to, and in proximity to the shield along the cable.

13. In a leaky coaxial cable system as defined in claim 12, termination circuits connected between the external wires and the shield.

14. In a leaky cable system as defined in claim 13, whereby field strength enhancement is desired in a particular radial direction from the coaxial cable, the external conductor being located along the cable opposite said radial direction.

15. In a leaky cable system comprising a leaky coaxial cable transmission line which includes a center conductor and a coaxial shield, an external conductor located parallel to, and in proximity with the shield along the cable, but insulated therefrom, and a termination circuit substantially matching the characteristic impedance of a transmission line formed by the external conductor and the coaxial cable shield, connected between the external conductor and the shield.

16. In a leaky cable system as defined in claim 15, the termination circuit being connected between the external conductor and the shield at a remote end of the external conductor.

17. In a leaky coaxial cable system comprising a leaky coaxial cable transmission line which includes a center conductor and a coaxial shield, an external conductor located parallel to, and in proximity with the shield along the cable, but insulated therefrom, a resonant circuit formed of an inductor in series with a capacitor and a resistor, the capacitor providing one terminal of the resonant circuit and being formed of a conductive foil covering a portion of the coaxial cable shield but insulated therefrom by an insulative jacket of the cable, the other terminal being connected to the external conductor.

18. In a leaky cable system comprising a leaky coaxial cable transmission line which includes a center conductor and a coaxial shield, an external conductor located parallel to, and in proximity with the shield along the cable, but insulated therefrom, in which the position of the external conductor is unrelated to holes in the shield of the cable, and in which the external conductor and coaxial cable are buried in a medium having varying conductivity and permittivity, the external conductor being located at varying angles between 0° and 90° under an approximately horizontal plane extending through the center conductor, the angle increasing where the conductivity and permittivity of the medium increase.

19. In a leaky cable system as defined in claim 18, a termination circuit substantially matching the characteristic impedance of the transmission line formed by the external conductor and the coaxial cable shield connected between the external conductor and the shield.

20. In a leaky cable system as defined in claim 19, the termination circuit being comprised of a resonsant circuit formed of an inductor in series with a capacitor and a resistor, the capacitor at one end of the resonant circuit being formed of a cylindrical conductive foil covering a portion of the coaxial cable shield but insulated therefrom by an insulative jacket of the cable, the other end of the resonant circuit being connected to the external conductor.

21. In a leaky cable system comprising a leaky coaxial cable transmission line which includes a center conductor and a coaxial shield, an external conductor located parallel to, and in proximity with the shield along the cable, but insulated therefrom, and a termination circuit connected between the external conductor and the shield in which the impedance of the termination circuit is predetermined and different from the characteristic impedance of a transmission line formed by the external conductor and the coaxial cable shield, whereby reflections of an electromagnetic field emanating from the leaky coaxial cable are produced at desired locations along the coaxial cable.

* * * * *